US006191748B1

(12) United States Patent
Chekroun et al.

(10) Patent No.: US 6,191,748 B1
(45) Date of Patent: Feb. 20, 2001

(54) ACTIVE MICROWAVE REFLECTOR FOR ELECTRONICALLY STEERED SCANNING ANTENNA

(75) Inventors: Claude Chekroun, Gif S/Yvette; Michel Dubois, Bures S/Yvette; Georges Guillaumot, Courcouronnes, all of (FR)

(73) Assignee: Thomson-CSF, Paris (FR)

( * ) Notice: Under 35 U.S.C. 154(b), the term of this patent shall be extended for 0 days.

(21) Appl. No.: 09/532,776

(22) Filed: Mar. 22, 2000

(51) Int. Cl.[7] ..... H01Q 17/00
(52) U.S. Cl. ..... 343/754; 343/755; 343/909
(58) Field of Search ..... 343/754, 755, 343/753, 757, 909, 700 MS; 342/381; H01Q 17/00

(56) References Cited

U.S. PATENT DOCUMENTS

| | | | | |
|---|---|---|---|---|
| 4,017,865 | * | 4/1977 | Woodward | 343/909 |
| 4,212,014 | | 7/1980 | Chekroun | 343/754 |
| 4,320,404 | | 3/1982 | Chekroun | 343/854 |
| 4,344,077 | | 8/1982 | Chekroun et al. | 343/754 |
| 4,447,815 | | 5/1984 | Chekroun et al. | 343/754 |
| 5,001,495 | | 3/1991 | Chekroun | 343/754 |
| 5,144,327 | | 9/1992 | Chekroun et al. | 343/754 |
| 5,237,328 | | 8/1993 | Dorey et al. | 342/13 |
| 5,373,302 | * | 12/1994 | Wu | 343/909 |
| 5,548,289 | | 8/1996 | Chekroun et al. | 342/16 |
| 5,598,172 | | 1/1997 | Chekroun | 343/754 |
| 5,635,939 | | 6/1997 | Chekroun | 342/384 |
| 5,680,136 | | 10/1997 | Chekroun | 342/6 |

* cited by examiner

*Primary Examiner*—Hoanganh Le
(74) *Attorney, Agent, or Firm*—Oblon, Spivak, McClelland, Maier & Neustadt, P.C.

(57) ABSTRACT

An electronically steered scanning active microwave reflector, capable of being illuminated by a microwave source to form an antenna, comprises a set of elementary cells, each comprising a phase-shifter microwave circuit placed before a conductive plane. This phase-shifter comprises conductive wires or tracks positioned on a support, the wires or tracks each comprising at least two two-state semiconductor elements, for example diodes, and being connected to conductors by which the states of the diodes can be controlled independently of each other, it being possible for each of the diodes to be on or off. Thus, four possible states are obtained and the geometrical and electrical characteristics of the cell are such that a given phase-shift value of the microwave received corresponds to each of these states. Finally, microwave decoupling means are provided between the cells. These means consist, in particular, of waveguides formed between two neighboring cells. The walls of these waveguides are parallel to the polarization of the waves and the spacing between these waveguides is such that it prohibits the propagation of the wave.

8 Claims, 4 Drawing Sheets

ACTIVE MICROWAVE REFLECTOR FOR ELECTRONICALLY STEERED SCANNING ANTENNA

BACKGROUND OF THE INVENTION

An object of the invention is an microwave reflector with electronically steered scanning that can be illuminated by a microwave source to form an antenna.

Electronically steered scanning antennas are usually formed by a set of radiating elements emitting a microwave whose phase can be electronically controlled, independently for each element or group of elements. An antenna whose beam is capable of scanning space in two orthogonal directions (2D) requires a large number of radiating elements. Their cost, namely the cost of the phase-shifters and of the associated electronic circuitry, generally makes this type of antenna very costly.

The aim of the invention is to enable the making of a 2D electronically steered scanning antenna for a cost that is substantially smaller, for comparable performance characteristics, than that of known antennas.

SUMMARY OF THE INVENTION

To this end, the antenna according to the invention consists of a linearly polarized microwave source illuminating an active microwave reflector. The active reflector according to the invention comprises a set of elementary cells, each comprising a phase-shifter microwave circuit placed before a conductive plane. This phase-shifter comprises conductive wires or tracks positioned on a support, the wires or tracks each comprising at least two two-state semiconductor elements, for example diodes, and being connected to conductors by which the states of the diodes can be controlled independently of each other, it being possible for each of the diodes to be on or off. Thus, four possible states are obtained and the geometrical and electrical characteristics of the cell are such that a given phase-shift value corresponds to each of these states. Finally, microwave decoupling means are provided between the cells. These means consist, in particular, of waveguides formed between two neighboring cells. The walls of these waveguides are parallel to the polarization of the waves and the spacing between these waveguides is such that it prohibits the propagation of the wave.

BRIEF DESCRIPTION OF THE DRAWINGS

Other objects, particular features and results of the invention shall appear from the following description, given by way of an example and illustrated by the appended drawings, of which.

In these different figures, the same references relate to the same elements.

MORE DETAILED DESCRIPTION

Figure 1:
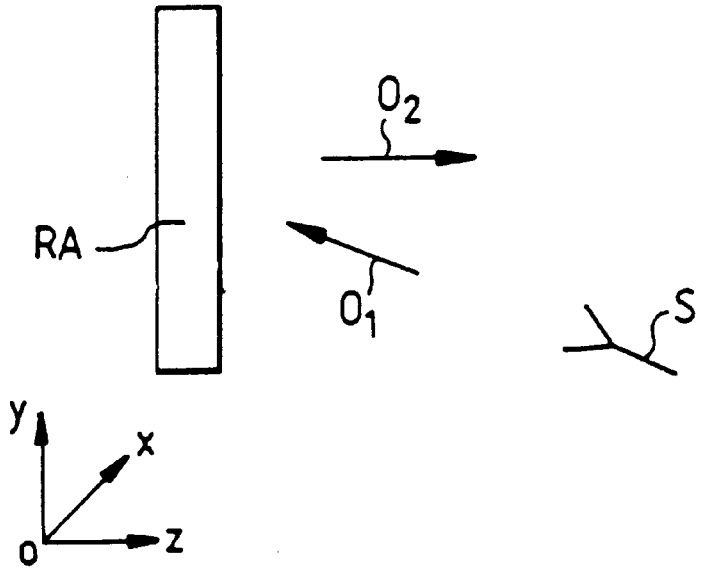
FIG. 1 is a general diagram of an antenna according to the invention.

FIG. 1 gives a diagrammatic view of the principle used by the antenna according to the invention.

The antenna is formed by a source S of linearly polarized microwaves $O_1$, parallel to a predefined direction OY, that illuminates an active reflector RA located in a plane, for example XOY, containing the direction OY.

Figure 2:
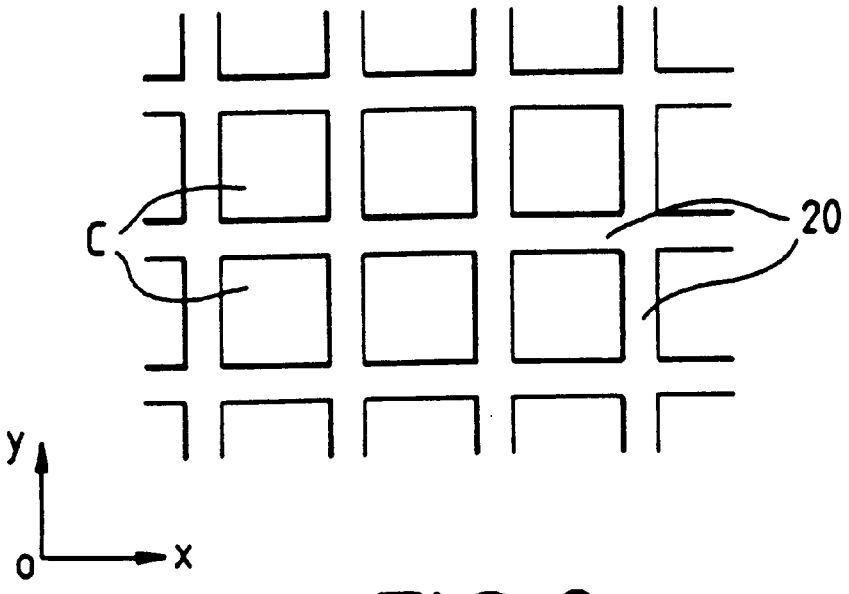
FIG. 2 is a drawing of a top view of the active reflector according to the invention.

The reflector RA is shown in a diagrammatic view in FIG. 2 and is seen in a top view (in the plane XOY).

This reflector consists of a set of elementary cells C positioned side by side and separated by zones 20 used for the microwave decoupling of the cells. Each cell is capable of reflecting the wave that it receives it with an electronically steered phase value, according to a method described further below.

Thus, by controlling the phase shifts communicated to the wave received by each cell, it is possible, as is known, to form a microwave beam $O_2$ (FIG. 1) in the desired direction.

Figure 3:
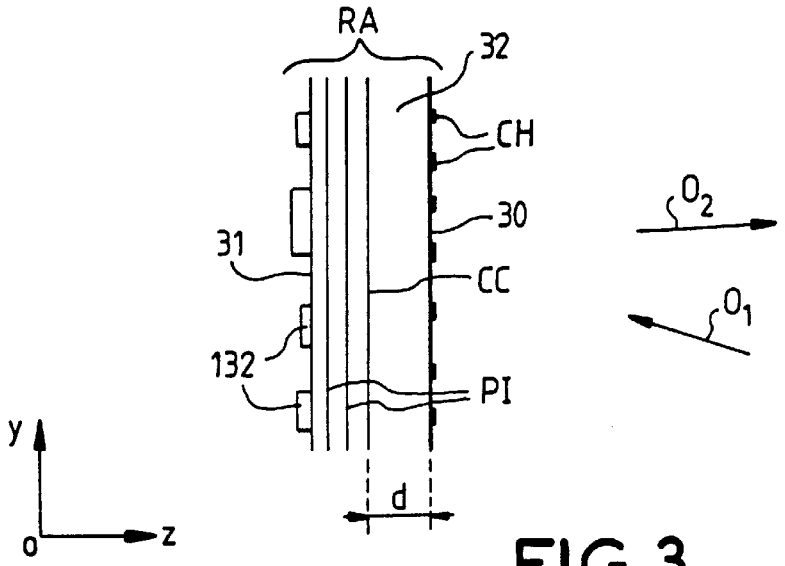
FIG. 3 is a drawing of a sectional view of an embodiment of the active reflector.

FIG. 3 provides a diagrammatic sectional view (in a plane YOZ normal to the plane XOY) of an embodiment of the active reflector RA.

The reflector RA consists of a microwave circuit CH, for example a substantially plane circuit, receiving the incident wave $O_1$, and a conductive plane CC, placed in a position that is substantially parallel to the circuit CH, at a predefined distance d from this circuit.

The conductive plane CC has the function of reflecting the microwaves. It may be formed by any known means, for example parallel wires sufficiently close to each other or a grating structure, or a continuous plane. The circuit CH and the plane CC are preferably made on two faces of a printed circuit type of dielectric support 32.

On the same printed circuit 32, which is then a multilayer circuit, the reflector RA furthermore preferably has the electronic circuit (components and interconnections) needed to control the phase values. The figure shows a multilayer circuit whose front face 30 bears the circuit CH while its rear face 31 bears the electronic components 132 and the intermediate layers forming the plane CC and for example two planes PI for the interconnection of the components 132 to the circuit CH.

Figure 4:
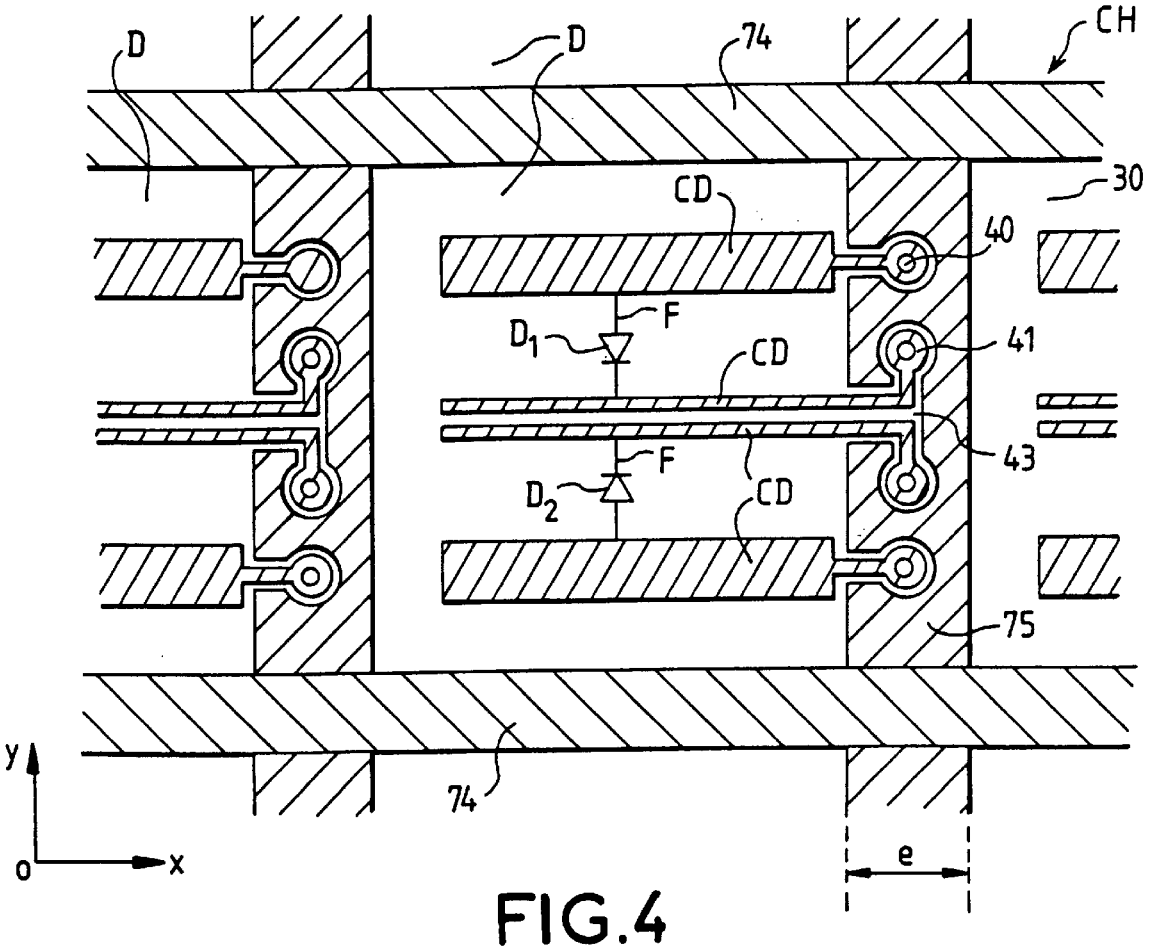
FIG. 4 shows an embodiment of a microwave circuit used in the active reflector.

FIG. 4 shows an embodiment of the microwave circuit CH.

The circuit CH consists of elementary phase-shifters D made on the surface 30 and separated by decoupling zones. Each phase-shifter D associated with the corresponding part of the conductive plane CC forms one of the elementary cells C of FIG. 2.

A phase-shifter D comprises one or more wires F (only one in FIG. 4), substantially parallel to the direction OY. Each wire F has at least two two-state semiconductor elements, $D_1$ and $D_2$, for example diodes, that are for example connected upside down with respect to each other, for example by their cathode. The supply voltage of the diodes $D_1$ and $D_2$ is conveyed by control conductors that are substantially parallel to each other and perpendicular to the wires F, referenced CD. There are at least three of them, or four as shown in the figure, in such a way that the diodes can be controlled independently of each other.

The phase-shifters D are surrounded by conductive zones positioned towards their periphery, bearing the reference 74 in a direction parallel to OX and the reference 75 in a direction parallel to OY, used for the decoupling as explained further below.

The conductors CD are connected to the electronic circuit borne by the reflector, by means of metallized holes 40 (41) made at the level of the conductive zones 75. These conductive zones 75 are of course electrically insulated from these conductors (for example by a gap 43 in the zone 75).

For the clarity of the figures, the surface of the different conductors, which is made for example in the form of metal deposits on the surface 30, is shown hatched although it cannot be seen in a sectional view.

To describe the working of the cell, it is necessary first of all to consider the equivalent circuit of a phase-shifter D as shown in FIG. 4.

The incident microwave, with a polarization (electrical field vector) that is rectilinear and parallel to OY and to the wires F, is received at terminals $B_1$ and $B_2$ and meets capacitances $C_O$, $C_{l1}$, $C_{l2}$, $C_{l3}$ in series that are parallel-connected to the terminals $B_1$ and $B_2$. The capacitance $C_O$ represents the capacitance per unit length of decoupling between the end conductors CD and the conductive zones 74; the capacitance $C_{l1}$ represents the capacitance per unit length between the conductors CD surrounding the diode $D_1$, the capacitance $C_{l3}$ represents the capacitance per unit length between the central conductors CD and the capacitance $C_{l2}$ is the equivalent of $C_{l1}$ for the diode $D_2$.

The diode $D_1$ is connected to the terminals of the capacitance $C_{l1}$. This diode $D_1$ is also represented by its equivalent diagram. This diagram consists of an inductance $L_1$, which is the inductance of the diode $D_1$ due to its connection wire (F), series-connected with:

- either a capacitance $C_{i1}$ (junction capacitance of the diode) series-connected with a resistance $R_{i1}$ (reverse resistance),
- or a resistance $R_{d1}$ (forward resistance of the diode), depending on whether the diode $D_1$ in the reverse or the forward direction, this fact being symbolized by a switch $\mathbf{2}_1$.

In the same way a diode $D_2$ is connected to the terminals of the capacitance $C_{l2}$. This diode $D_2$ is represented by its equivalent diagram. This diagram is similar to that of the diode $D_1$, its components having been given the index 2.

The microwave output voltage is taken between the terminals $B_3$ and $B_4$ which are the terminals of the capacitances $C_0$, $C_{l1}$, $C_{l2}$ and $C_{l3}$.

The working of the phase-shifter D is explained here below. This description will consider, in a first step, the behavior of such a circuit in the absence of the diode $D_2$ and of the central conductors CD. In the equivalent diagram of FIG. 5, this amounts to eliminating the unit $D_2$ as well as the capacitances $C_{l2}$ and $C_{l3}$.

Figure 5:
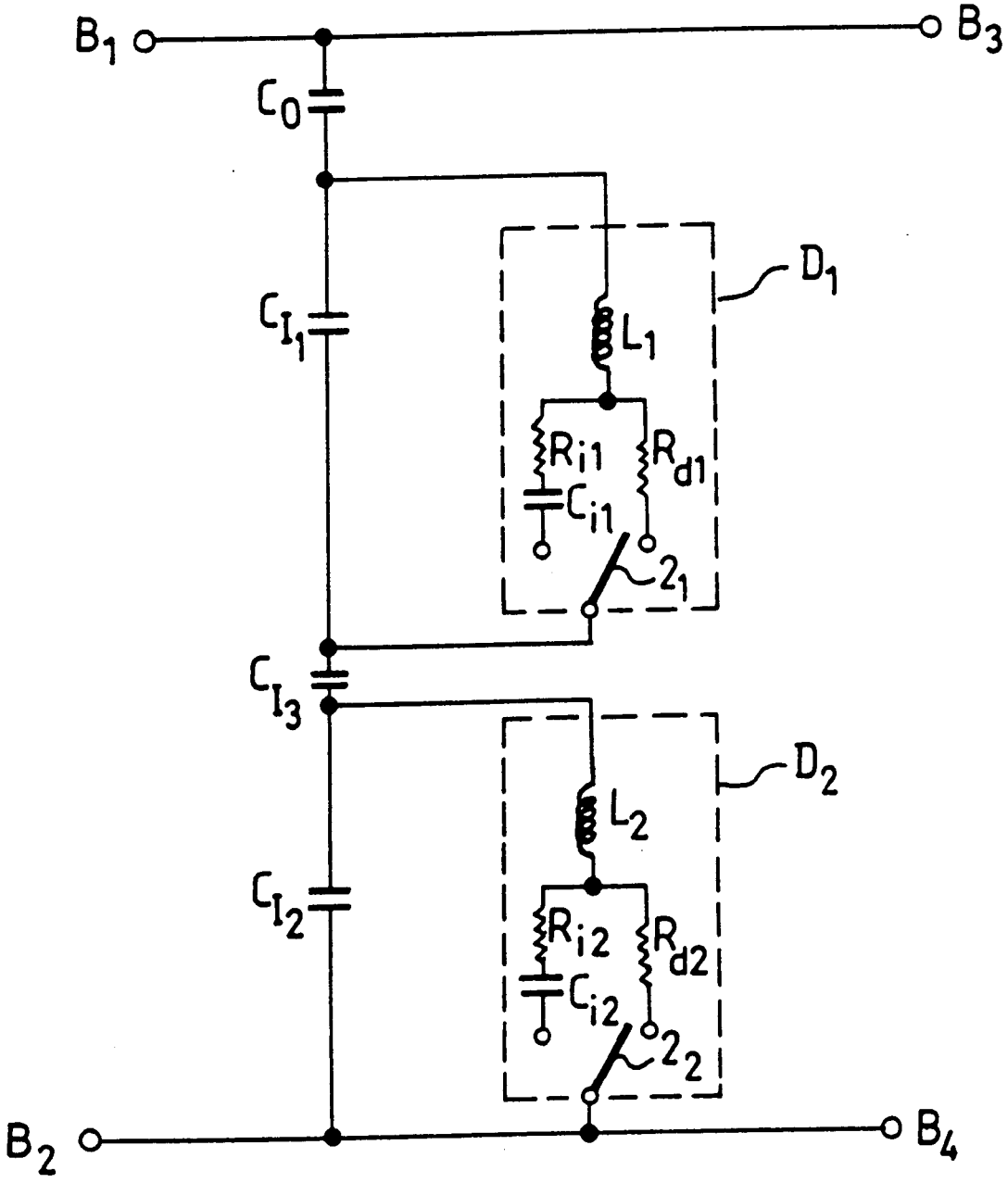
FIG. 5 shows the equivalent circuit of the previous microwave reflector.

When the diode $D_1$ is forward-biased, the susceptance ($B_{d1}$) of the circuit of FIG. 5 (modified) is written as follows:

$$B_{d1} = Z \cdot C_0 \cdot \omega \cdot \frac{1 - LC_{l1}\omega^2}{LC_{l1}\omega^2 + LC_0\omega^2 - 1}$$

where Z is the impedance of the incident wave and ω is the corresponding pulsation at the central frequency of the operating band of the device.

The parameters of the circuit are chosen for example to have $B_{d1} \approx 0$. This means that, by overlooking its conductance, the circuit is adapted or, in other words, that it is transparent to the incident microwave, introducing neither parasitic reflection nor any phase shift ($d\phi_{d1}=0$). More specifically, we choose:

$$LC_{l1}\omega^2 = 1$$

leading to $B_{d1} \approx 0$, whatever may be the value of the capacitance $C_{i1}$.

When the diode $D_1$ is reverse-biased, the susceptance ($B_{r2}$) of the circuit is written as follows:

$$B_{r1} = Z \cdot C_0 \cdot \omega \cdot \frac{1 - LC_{l1}\omega^2 + (C_{l1}/Ci)}{LC_{l1}\omega^2 + LC_0\omega^2 - 1 + \frac{C_0 + C_{l1}}{C_i}}$$

The value of the capacitance $C_{l1}$ being fixed previously, it can be seen that the value of the susceptance $B_{r1}$ can be adjusted by action on the value of the capacitance $C_i$, namely the choice of the diode $D_1$.

If, now, in a second step, the existence of the diode $D_2$ and of the central conductors CD is taken into consideration, it can be seen that, by a similar process of reasoning, two other distinct values are obtained for the susceptance depending on whether the diode $D_2$ is forward-biased or reverse-biased.

It can thus be seen that a phase-shifter D can have four different values for its susceptance $B_D$ (referenced $B_{D1}$, $B_{D2}$, $B_{D3}$ and $B_{D4}$) depending on the command (forward-bias or reverse-bias) applied to each of the diodes $D_1$ and $D_2$. These values are a function of the parameters of the circuit of FIG. 5, namely of the values chosen for the geometrical parameters (dimensions, shapes and spacings of the different conductive surfaces) and electrical parameters (electrical characteristics of the diodes) of the phase-shifter.

If the behavior of the entire cell, namely the phase-shifter D and the conductive plane CC, is now examined, it is necessary to take account of the susceptance due to the plane CC, transposed to the plane of the phase-shifter and referenced $B_{CC}$ which can be written as follows:

$$B_{cc} = -\text{cotg}\frac{2\pi d}{\lambda}$$

where λ is the wavelength corresponding to the pulsation ω.

The susceptance $B_C$ of the cell is then given by:

$$B_C = B_D + B_{CC}$$

It follows that the susceptance $B_C$ can take four distinct values (referenced $B_{C1}$, $B_{C2}$, $B_{C3}$ and $B_{C4}$) corresponding respectively to the four values of $B_D$, the distance d representing an additional parameter to determine the values $B_{C1}$–$B_{C4}$.

It is furthermore known that the phase shift (dϕ) communicated by an admittance (Y) to a microwave has the form:

$$d\phi = 2 \arctan Y$$

It can thus be seen that, overlooking the real part of the admittance of a cell, we have:

$$d\phi \approx 2 \arctan B_C$$

and that we obtain four possible values ($d\phi_1$–$d\phi_4$) of phase shift per cell, depending on the command applied to each of the diodes $D_1$ and $D_2$. The different parameters are chosen so that the four values $d\phi_1$–$d\phi_4$) are equally distributed, for example as follows, though not obligatorily so: 0, 90°, 180°, 270°.

It must be noted that here above we have described a case where the parameters of the circuit are chosen so that the zero susceptance values (or substantially zero susceptance values) are such that they correspond to the forward-biased diodes but it is possible of course to choose a symmetrical type of operation in which the parameters are determined to substantially cancel the susceptance values $B_r$. More generally, it is not necessary for one of the susceptance values $B_d$ or $B_r$ to be zero, these values being determined so that the condition of equal distribution of the phase shifts $d\phi_1$–$d\phi_4$ are met.

Furthermore, should a cell have more than one wire F with diodes, the operation and the way in which the parameters are determined are of the same type provided that the equivalent circuit is modified accordingly and that that the interaction between the diode-fitted wires is taken into account.

The active reflector according to the invention also has means of decoupling between the cells C.

The microwave received by the cells is linearly polarized in parallel to the direction OY. It is desirable that this wave should not get propagated from one cell to another, in the direction OX. To prevent such propagation, the invention envisages the placing of a substantially strip-shaped conductive zone 75, made by metal deposition on the surface 30 for example, between the cells, parallel to the direction OY. This strip 75, along with the reflective plane CC which is underneath, forms a space of the waveguide type whose width is the distance d. According to the invention, the distance d is chosen to that it is less than $\lambda/2$, it being known that a wave whose polarization is parallel to the bands cannot get propagated in such a space. In practice, the reflector according to the invention works in a certain band of frequencies and d is chosen so that it is smaller than the smallest of the wavelengths of the band. Naturally, it is necessary to take account of this constraint when determining the different parameters for fixing the phase shifts $d\phi_1$–$d\phi_4$. Furthermore, the band 75 must have a width e along the direction OX that is sufficient for the above-described effect to be appreciable. In practice, the width e may be in the range of $\lambda/15$.

Furthermore, a wave may be created parasitically in the cell, with its polarization directed along the direction OZ (perpendicular to the directions OX and OY). It is also desirable to avoid its propagation towards the neighboring cells.

With respect to neighboring cells in the direction OX, it is possible, as shown in FIG. 4, to use the metallized holes 40–41 for the connection of the conductor CD to the electronic control circuit. Indeed, since these holes are parallel to the polarization of the parasite wave, they are equivalent to a conductive plane. If they are sufficiently close to each other (at a distance far smaller than the operating wavelength of the reflector), and therefore numerous, they form a shield for the operating wavelengths of the reflector. If this condition is not fulfilled, it is of course possible to form additional metallized holes that do not have any connection function. It must be noted that these metallized holes 40–41 are preferably made in the strips 75 so as not to disturb the working of the cell.

Figure 6:
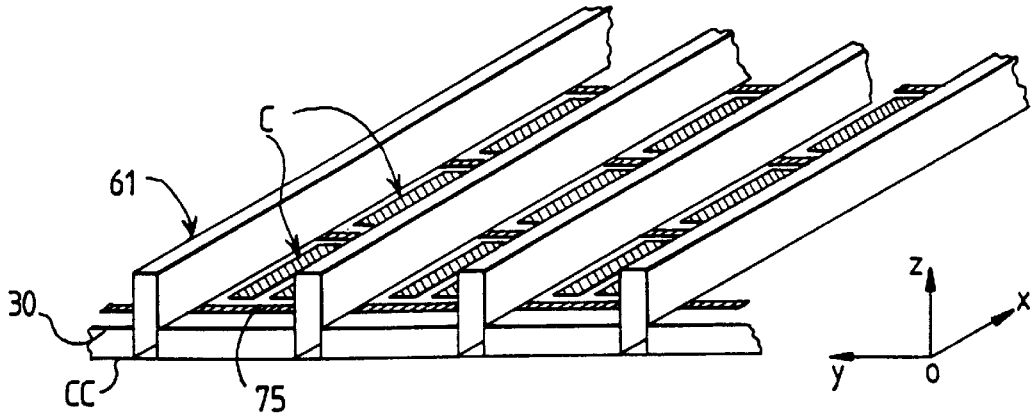
FIG. 6 shows a practical embodiment of an element for the decoupling of the cells from one another.

Finally, with respect to neighboring cells in the direction OY, it is possible either to use metallized holes similar to the holes 40–41 but aligned in the direction OX or to position a conductive surface that is continuous in the plane XOZ as shown in FIG. 6 where plates 61 have been shown stretching in a direction parallel to the plane XOZ from the plane CC (the intersection of these plates 61 with the surface 30 forms a zone 74 of FIG. 4). These plates may advantageously extend beyond the surface 30 on a height that is not of critical importance, for example less than $\lambda/10$, equal to $\lambda/10$ or to a few multiples of $\lambda/10$, in order to improve the decoupling.

Figure 7:
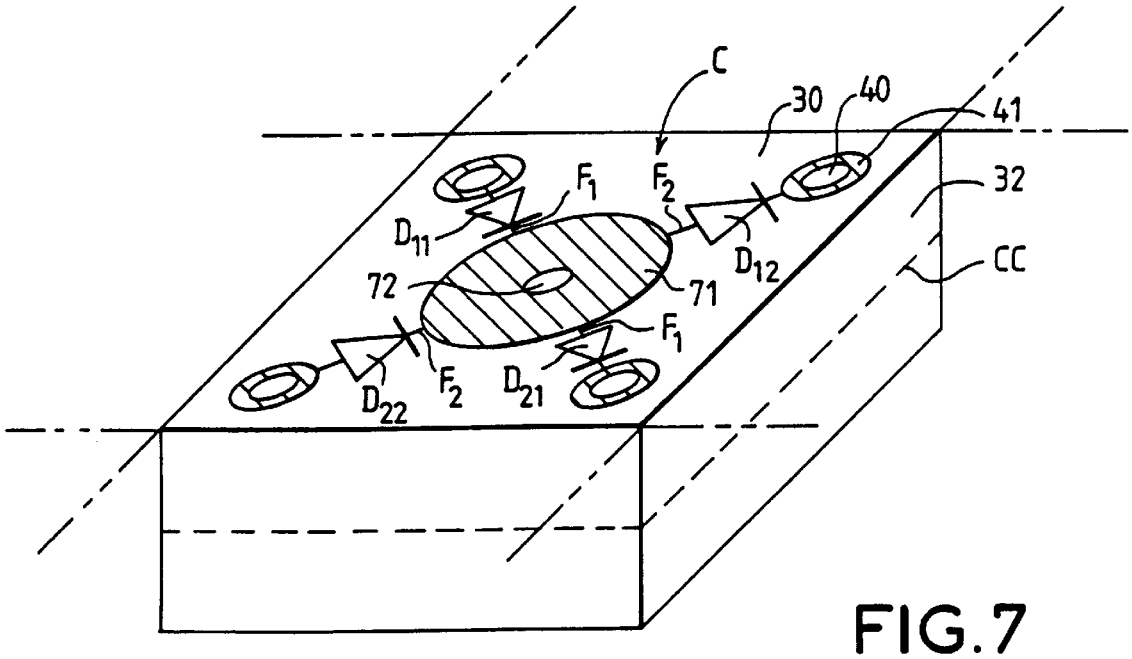
FIG. 7 shows another embodiment of the microwave circuit enabling the making of a bi-polarization antenna.

FIG. 7 shows another embodiment of the microwave circuit CH with which a bipolarization antenna can be made.

This figure shows a view in perspective of a single cell C. The phase-shifter circuit borne on the surface 30 of the substrate 32 is now formed by two wires $F_1$, $F_2$, each bearing two semiconductor elements such as diodes ($D_{11}$, $D_{21}$, $D_{12}$, $D_{22}$). These diodes are connected for example to one and the same central conductor 72 which is itself connected by a metallized hole 72 to the electronic control circuit of the reflector. Each of the diode-fitted wires herein acts only on those waves whose polarization has a component that is parallel to them according to the same process as the one described here above, provided that differences in the geometry of the conductors are taken into account.

What is claimed is:

1. An active microwave reflector, capable of receiving an electromagnetic wave linearly polarized in a first given direction, the reflector comprising a set of elementary cells positioned beside one another on a surface, each cell comprising a phase-shifter microwave circuit and a conductive plane positioned substantially parallel to the microwave circuit, at a predefined distance from this circuit, this distance being smaller than half of the smallest wavelength of the operating band of the reflector, the phase-shifter circuit comprising a dielectric support, at least one electrically conductive wire substantially parallel to the given direction, positioned on the support and bearing at least two two-state semiconductor elements, the wire being connected to control conductors for the semiconductor elements that are substantially normal to the wires, the control conductors being at least three in number to control the state of the semiconductor elements independently of one another, and second conductive zones positioned towards the periphery of the cell substantially in parallel to the control conductors, the geometrical and electrical characteristics of the cell being such that, to each of the states of the semiconductor elements, there corresponds a given value of phase-shift ($d\phi_1$, $d\phi_2$, $d\phi_3$, $d\phi_4$) of the electromagnetic wave that is reflected by the cell, the reflector furthermore comprising an electronic circuit to control the state of the semiconductor elements, connected to the control conductors and means of microwave decoupling between the cells, these means comprising a second conductive zone positioned between each cell, parallel to the given direction, this second conductive zone forming, with the conductive plane, a guided space where the wave cannot get propagated.

2. A reflector according to claim 1, wherein the dielectric support is of the multilayer printed circuit type having a first face bearing the microwave circuit, a first intermediate layer bearing the conductive plane and the second face bearing components of the control circuit.

3. A reflector according to claim 2, wherein the dielectric support furthermore comprises at least one second intermediate layer bearing interconnections of the control circuit.

4. A reflector according claim 2, comprising metallized holes made in the dielectric support, in a second direction substantially normal to the first direction, at a distance from one another that is far smaller than the electromagnetic wavelength, at least some of these metallized holes providing a link between the control circuit and the control conductors.

5. A reflector according to claim 4, wherein the metallized holes are made in the second conductive zone but without any electrical contact with this zone.

6. A reflector according to claim 1, wherein the first conductive zones are extended by conductive planes substantially perpendicular to the first direction, extending at least between the conductive plane and the phase-shifter circuit.

7. A reflector according to claim 1, wherein the semiconductor elements are diodes.

8. An electronically steered scanning microwave antenna, comprising a reflector according to one of the foregoing claims and a microwave source illuminating the reflector.

* * * * *